US012734398B2

(12) United States Patent
Hsu

(10) Patent No.: US 12,734,398 B2
(45) Date of Patent: Sep. 15, 2026

(54) ELLIPTICAL TRAINER

(71) Applicant: Chih-Yung Hsu, Tainan City (TW)

(72) Inventor: Chih-Yung Hsu, Tainan City (TW)

( * ) Notice: Subject to any disclaimer, the term of this patent is extended or adjusted under 35 U.S.C. 154(b) by 92 days.

(21) Appl. No.: 18/977,043

(22) Filed: Dec. 11, 2024

(65) Prior Publication Data

US 2026/0108774 A1 Apr. 23, 2026

(30) Foreign Application Priority Data

Oct. 17, 2024 (TW) ..... 113139575

(51) Int. Cl.

| | |
|---|---|
| ***A63B 22/00*** | (2006.01) |
| ***A63B 21/00*** | (2006.01) |
| ***A63B 21/22*** | (2006.01) |
| ***A63B 22/06*** | (2006.01) |

(52) U.S. Cl.

CPC ..... *A63B 22/0056* (2013.01); *A63B 21/22* (2013.01); *A63B 21/4034* (2015.10); *A63B 21/4035* (2015.10); *A63B 21/4047* (2015.10); *A63B 22/001* (2013.01); *A63B 22/0664* (2013.01)

(58) Field of Classification Search

CPC . A63B 22/0056; A63B 21/22; A63B 21/4034; A63B 21/4035; A63B 21/4047; A63B 22/001; A63B 22/0664

See application file for complete search history.

(56) References Cited

U.S. PATENT DOCUMENTS

| | | | | |
|---|---|---|---|---|
| 5,957,814 | A * | 9/1999 | Eschenbach | A63B 22/0664 482/57 |
| 7,862,482 | B1 * | 1/2011 | Hsu | A63B 22/001 482/52 |
| 9,579,537 | B1 * | 2/2017 | Peng | A63B 22/0664 |
| 9,586,087 | B1 * | 3/2017 | Lin | A63B 22/0664 |
| 9,849,332 | B1 * | 12/2017 | Huang | A63B 23/03575 |
| 9,873,014 | B1 * | 1/2018 | Kuo | A63B 22/0015 |
| 9,925,412 | B1 * | 3/2018 | Lu | A63B 22/001 |
| 10,022,586 | B1 * | 7/2018 | Lee | A63B 22/0664 |
| 10,022,588 | B1 * | 7/2018 | Lee | A63B 23/03525 |
| 10,500,436 | B1 * | 12/2019 | Lu | A63B 23/03575 |
| 10,926,132 | B1 * | 2/2021 | Lo | A63B 22/0664 |
| 2005/0148438 | A1 * | 7/2005 | Carlsen | A63B 22/0664 482/52 |
| 2005/0164835 | A1 * | 7/2005 | Porth | A63B 22/0023 482/52 |
| 2006/0172865 | A1 * | 8/2006 | Dey | A63B 22/0007 482/52 |
| 2007/0015632 | A1 * | 1/2007 | Eschenbach | A63B 22/0664 482/52 |
| 2008/0269023 | A1 * | 10/2008 | Chuang | A63B 22/0017 482/52 |

(Continued)

FOREIGN PATENT DOCUMENTS

| | | |
|---|---|---|
| TW | M383421 U | 7/2010 |
| TW | I671098 B | 9/2019 |

*Primary Examiner* — Sundhara M Ganesan

(74) *Attorney, Agent, or Firm* — Rosenberg, Klein & Lee

(57) ABSTRACT

An elliptical trainer includes a frame; two pedal units, disposed on two opposite sides of the frame; two linkage units, disposed on the two opposite sides of the frame and connected to the two pedal units; and a resistance unit, disposed on the frame. The two pedal units are connected to the resistance unit via the corresponding linkage units.

10 Claims, 18 Drawing Sheets

(56) References Cited

U.S. PATENT DOCUMENTS

| | | | | |
|---|---|---|---|---|
| 2009/0291810 | A1* | 11/2009 | Kwon | A63B 22/0056 482/52 |
| 2009/0312157 | A1* | 12/2009 | Shen | A63B 22/0023 482/52 |
| 2011/0130250 | A1* | 6/2011 | Reggiani | A63B 22/0664 482/23 |
| 2012/0289380 | A1* | 11/2012 | Chen | A63B 22/0664 482/52 |
| 2013/0035212 | A1* | 2/2013 | Chuang | A63B 22/0664 482/52 |
| 2013/0143720 | A1* | 6/2013 | Chuang | A63B 22/0664 482/52 |
| 2013/0237380 | A1* | 9/2013 | Kao | A63B 21/15 482/52 |
| 2013/0244837 | A1* | 9/2013 | Chen | A63B 22/0015 482/52 |
| 2014/0194256 | A1* | 7/2014 | Huang | A63B 23/03591 482/52 |
| 2014/0221166 | A1* | 8/2014 | Huang | A63B 22/0664 482/52 |
| 2014/0248998 | A1* | 9/2014 | Lu | A63B 22/04 482/52 |
| 2016/0263428 | A1* | 9/2016 | Wu | A63B 22/0017 |
| 2016/0263433 | A1* | 9/2016 | Wu | A63B 22/0015 |
| 2016/0375300 | A1* | 12/2016 | Chang | A63B 22/001 482/52 |
| 2020/0038706 | A1* | 2/2020 | Liu | A63B 22/0056 |
| 2020/0114199 | A1* | 4/2020 | Lee | A63B 21/4035 |
| 2020/0121982 | A1* | 4/2020 | Yu | A63B 21/159 |
| 2020/0206561 | A1* | 7/2020 | Liao | A63B 22/208 |
| 2020/0346069 | A1* | 11/2020 | Tracy | A63B 22/001 |
| 2021/0178222 | A1* | 6/2021 | Lo | A63B 22/201 |

* cited by examiner

ELLIPTICAL TRAINER

FIELD OF THE INVENTION

The present invention relates to an exercise machine, and more particularly to an elliptical trainer designed to simulate the actions of walking.

BACKGROUND OF THE INVENTION

There are various exercise machines in the gym for physical exercise, such as treadmills, spin bikes, dumbbells, leg press machines, rowing machines, glute kickback machines, and so on.

In order to train multiple muscle groups using a single exercise machine, an elliptical trainer is often used. An elliptical trainer is a stationary exercise machine used to simulate the actions of cycling, stair climbing, rowing and running. An elliptical machine is also called a cross-trainer.

Taiwan Utility Model Publication No. TWM383421U discloses an elliptical walking machine capable of adjusting stride length. A rotating wheel bracket and a rotating wheel are disposed at the front end of a base. A side frame is disposed on either side of the base. A fulcrum shaft extending inwardly is disposed on the upper end of the side frame. A walking linkage unit is disposed on either side of the base. The walking linkage unit is pivotally connected to the rotating wheel shaft and the fulcrum shaft. The junction of a rear connecting rod and a lower connecting rod of the walking linkage unit is pivoted by an adjustable connecting seat that can slide up and down, such that the swing trajectory and stride length of the elliptical walking machine can be adjusted. A pedal rod of the walking linkage unit is provided with a pedal assembly that can swing up and down. Adjusting the mounting angle between the foot pedal and the pedal rod can effectively improve the comfort of the user's ankles during exercise.

Taiwan Patent Publication No. TWI671098B discloses a multi-function elliptical trainer that can determine a stride length by itself, comprising a frame unit, a resistance unit, a transmission unit, and two linkage units. The resistance unit includes a first resistance member and a second resistance member. The transmission unit includes a crank member, a first transmission assembly connected between the crank member and the first resistance member, and a second transmission assembly connected to the second resistance member. Each linkage unit can change between an up-and-down motion state and a front-and-back motion state. In the up-and-down motion state, the linkage unit sequentially drives the crank member, the first transmission assembly and the first resistance member. In the front-and-back motion state, the linkage unit sequentially drives the second transmission assembly and the second resistance member. Because the components driven by the linkage unit in the up-and-down motion state and in the front-and-back motion state are different, there is no restriction on the stride length in the front-to-back direction, and the stride length can be determined by itself to achieve a better fitness effect. When in use, the foot pedal is always tilted forward. When the foot pedal is moved to the frontmost position, the user's foot that moves to the front edge will tread the pedal on tiptoe. Under long-term use, poor posture will cause damage to the feet.

SUMMARY OF THE INVENTION

The primary object of the present invention is to provide an elliptical trainer which can simulate the actual walking or running motion of the human body, that is, the toes of the foot that moves to the front edge are raised and the heel of the foot that moves to the rear edge is raised.

The elliptical trainer provided by the present invention comprises a frame, two pedal units, two linkage units, and a resistance unit. The frame includes a base, a post, and a front connecting bracket. The base extends in a horizontal direction. The post is fixed to the base and extends in a height direction. The front connecting bracket is connected between the base and the post. The frame has a first pivot part, a second pivot part and a third pivot part that are arranged on the frame sequentially from high to low in the height direction. The second pivot part is located between the first pivot part and the third pivot part in the horizontal direction. The first pivot part and the second pivot part are disposed on the post. The third pivot part is disposed on the front connecting bracket. Two pedal units are disposed on two opposite sides of the frame. The pedal units each include a handlebar rod, a pedal rod, a pedal bottom rod, and a foot pedal. The foot pedal has a pedal face. Upper and lower ends of the handlebar rod are pivotally connected to the first pivot part and one end of the pedal bottom rod, respectively. Another end of the pedal bottom rod is pivotally connected to a lower pivot point of the foot pedal. One end of the pedal rod is pivotally connected to an upper pivot point of the foot pedal. The upper pivot point and the lower pivot point are arranged adjacent to each other in the height direction. The pedal rod has a pedal rod connection point between two opposite ends thereof. The handlebar rod has a handlebar rod connection point between the upper and lower ends thereof. The pedal rod connection point is connected to the handlebar rod connection point so that the pedal rod is pivotally connected to the handlebar rod. Two linkage units are disposed on the two opposite sides of the frame and connected to the two pedal units, respectively. The linkage units each include a first bar, a second bar, a third bar, a fourth bar, and a rotating shaft connecting member. One end of the first bar is pivotally connected to the second pivot part. Another end of the first bar is pivotally connected to one end of the second bar. Another end of the second bar and one end of the third bar are pivotally connected to one end of the rotating shaft connecting member. Another end of the rotating shaft connecting member is pivotally connected to the third pivot part. The rotating shaft connecting members of the two linkage units on the two sides of the frame are arranged 180 degrees apart in a radial direction of the third pivot part. The first bar has a first bar connection point between the two opposite ends of the first bar. The fourth bar has a fourth bar connection point between two opposite ends of the fourth bar. One end of the fourth bar is pivotally connected to the first bar connection point. Another end of the third bar is pivotally connected to the fourth bar connection point. The other end the fourth bar is pivotally connected to the other end of the pedal rod. The resistance unit is disposed on the frame and connected to the third pivot part. The two pedal units are connected to the resistance unit via the corresponding linkage units. When in use, the foot pedals of the two pedal units on the two sides of the frame are driven to move along a closed path, and the two foot pedals are located on two opposite sides of a center of the closed path when moved. When the two foot pedals are moved and located on the two opposite sides of the center of the closed path in the horizontal direction, the pedal faces of the two foot pedals are inclined at an angle toward the center of the closed path.

Preferably, the first bar, the second bar, the third bar and the fourth bar are connected to form a four-bar linkage.

Preferably, a first distance from the handlebar rod connection point to the lower end of the handlebar rod connected to the pedal bottom rod is less than a second distance between the upper pivot point and the lower pivot point.

Preferably, the pedal units each include a movable handlebar. The movable handlebar is connected to the upper end of the handlebar rod. The two movable handlebars of the pedal units extend in the height direction and have a gradually enlarged section and a gripping section.

Preferably, the frame further includes an upper arm, two immovable handlebars, and a display screen. The upper arm extends in the height direction and is fixed to the post. The two immovable handlebars are fixed to two sides of the upper arm. The display screen is fixed to an upper end of the upper arm.

Preferably, the base includes a base body and two transverse supports. The two transverse supports are connected to two opposite ends of the base body. The two transverse supports each have two support feet and two guide wheels.

Preferably, the frame includes two side armrests. Front ends of the two side armrests are connected to two opposite sides of the post. Rear ends of the two side armrests are connected to a rear one of the two transverse supports. The two pedal units are located between the two side armrests.

Preferably, the front connecting bracket includes a left connecting bracket and a right connecting bracket. The left connecting bracket and the right connecting bracket are spaced a determined distance apart from each other. The third pivot part includes two shaft seats and a rotating shaft. The two shaft seats are fixed to the left connecting bracket and the right connecting bracket, respectively. The rotating shaft is rotatably connected to the two shaft seats.

Preferably, the third pivot part further includes two adjustment screw assemblies. The two adjustment screw assemblies are arranged adjacent to the two shaft seats, respectively. The two adjustment screw assemblies each have two adjustment screws. The two adjustment screws are rotatable and are against two opposite ends of a corresponding one of the shaft seats, respectively.

Preferably, the resistance unit includes an output wheel, a transmission wheel, and a resistance wheel. The output wheel is disposed on the rotating shaft and rotates synchronously along with the rotating shaft. The transmission wheel and the resistance wheel are rotatably connected to the frame. The output wheel drives and is connected to the transmission wheel via a first belt. The transmission wheel drives and is connected to the resistance wheel via a second belt.

According to the above technical features, the present invention can achieve the following effects:

1. The elliptical trainer can be used to train the actions of cycling, stair climbing, and rowing. When the user's feet tread the foot pedals for physical exercise, the toes of the foot that moves to the front edge are raised and the heel of the foot that moves to the rear edge is raised. The motions are closer to actual walking or running.
2. In addition to training the lower limbs, the user can grasp the movable handlebars to simulate the action of rowing, thereby training the upper limbs at the same time. Besides, when there is no need to train the upper limbs, the user's hands can grasp the side armrests or the immovable handlebars to take a rest.
3. By adjusting the resistance of the resistance wheel, the force to drive the foot pedals can be adjusted to increase decrease the training load.

DESCRIPTION OF THE PREFERRED EMBODIMENTS

Embodiments of the present invention will now be described, by way of example only, with reference to the accompanying drawings.

Figure 1:
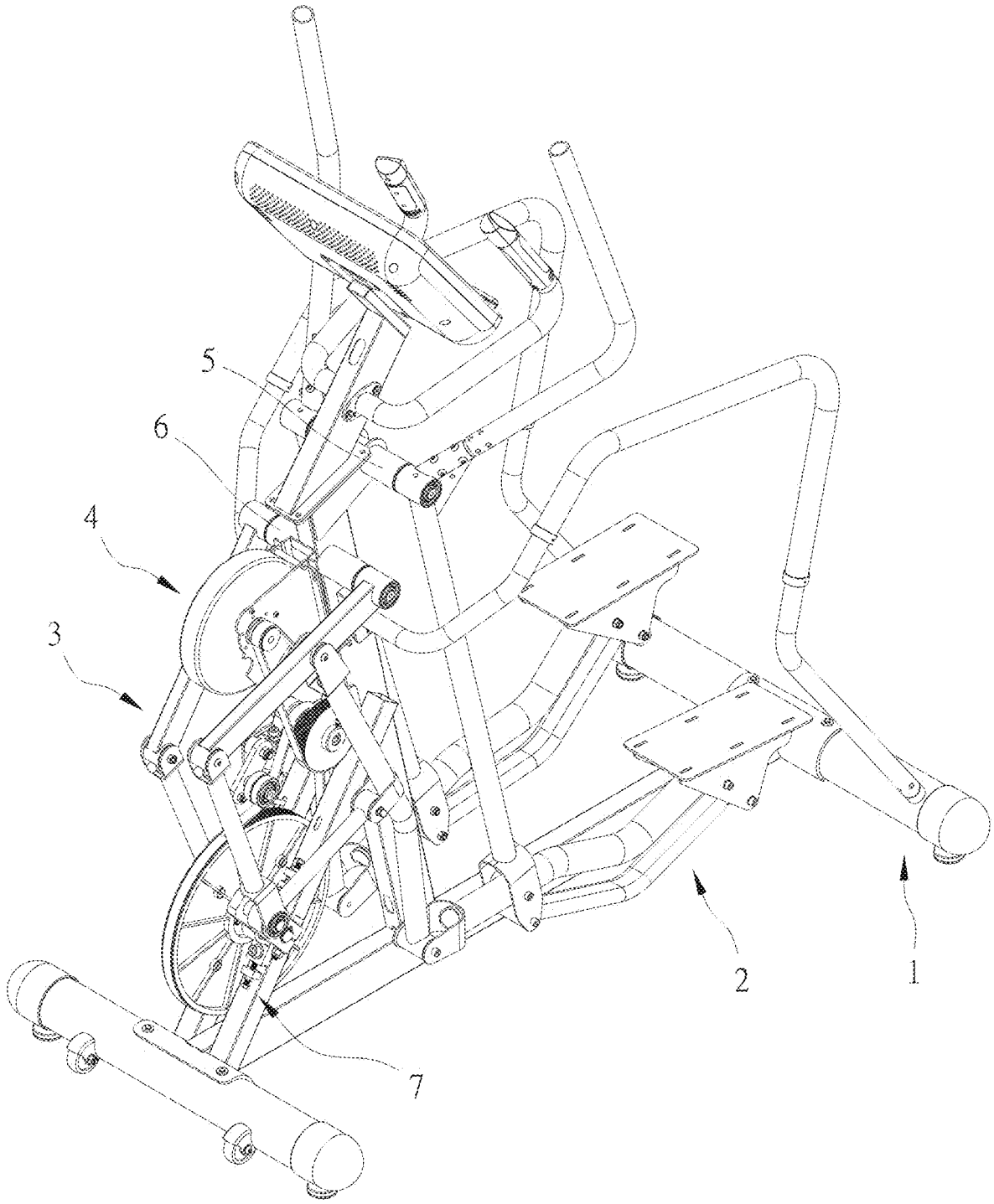
FIG. 1 is a perspective view of the present invention.
Figure 2:
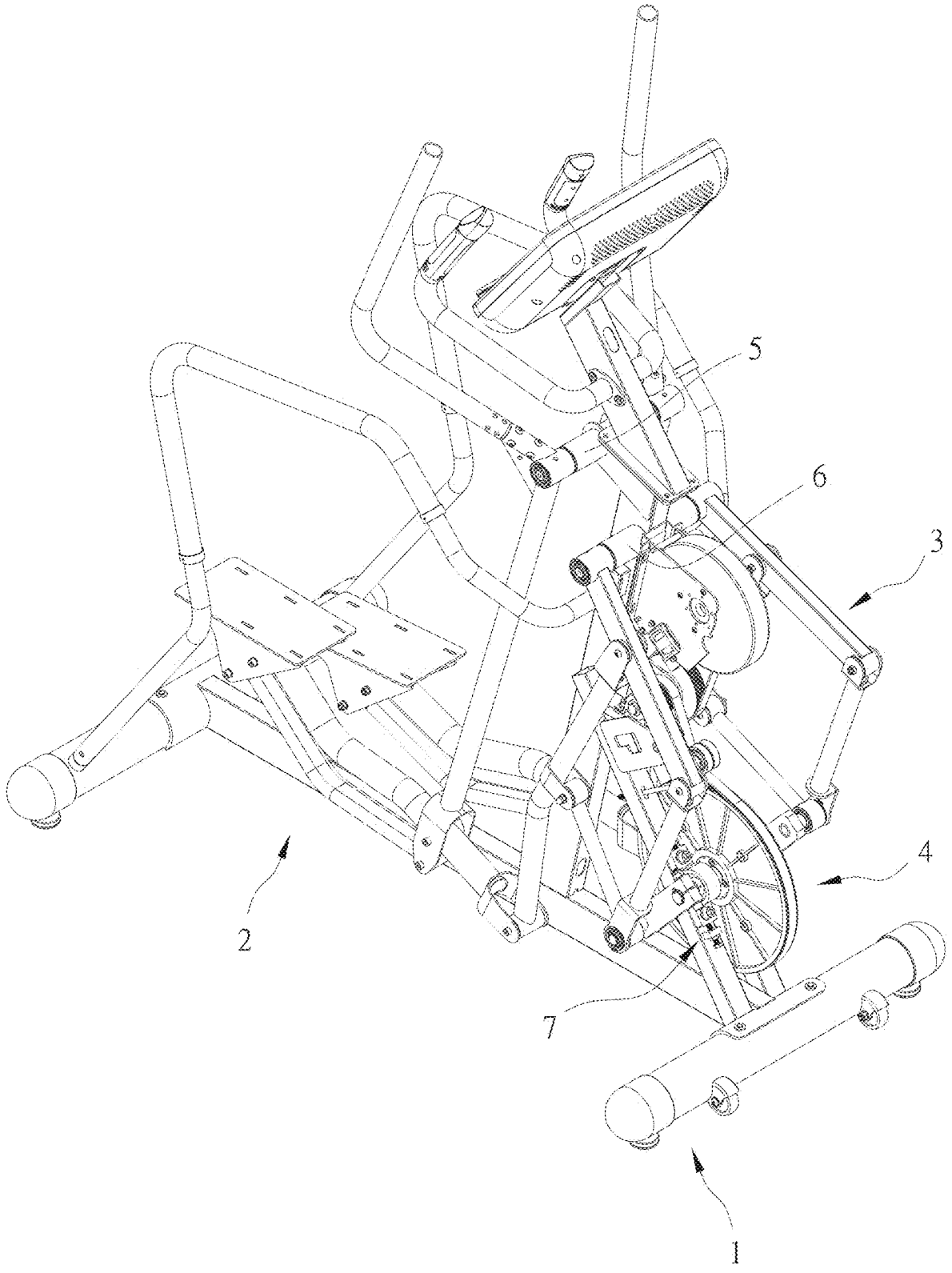
FIG. 2 is another perspective view of the present invention.
Figure 3:
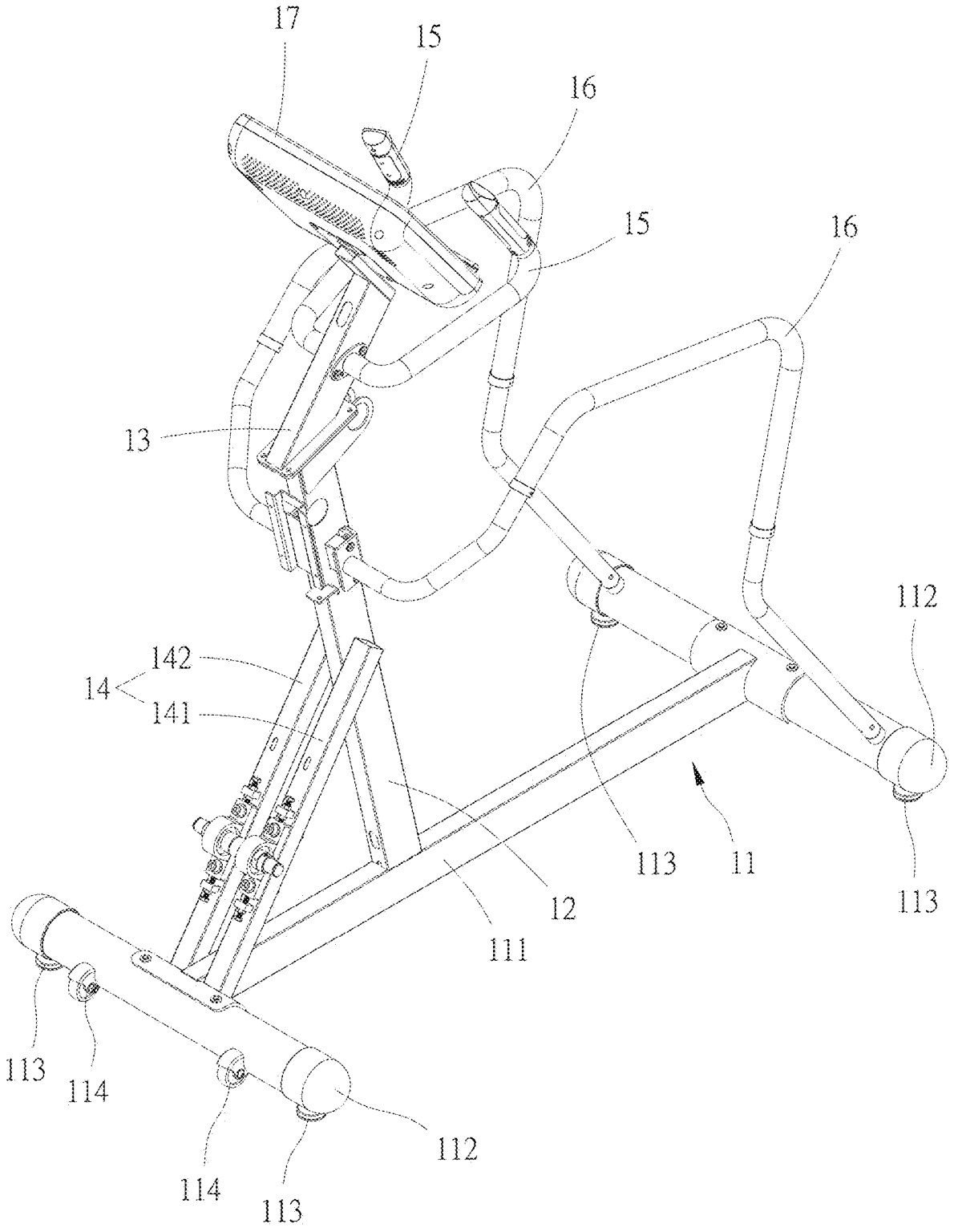
FIG. 3 is a perspective view of the frame of the present invention.
Figure 4:
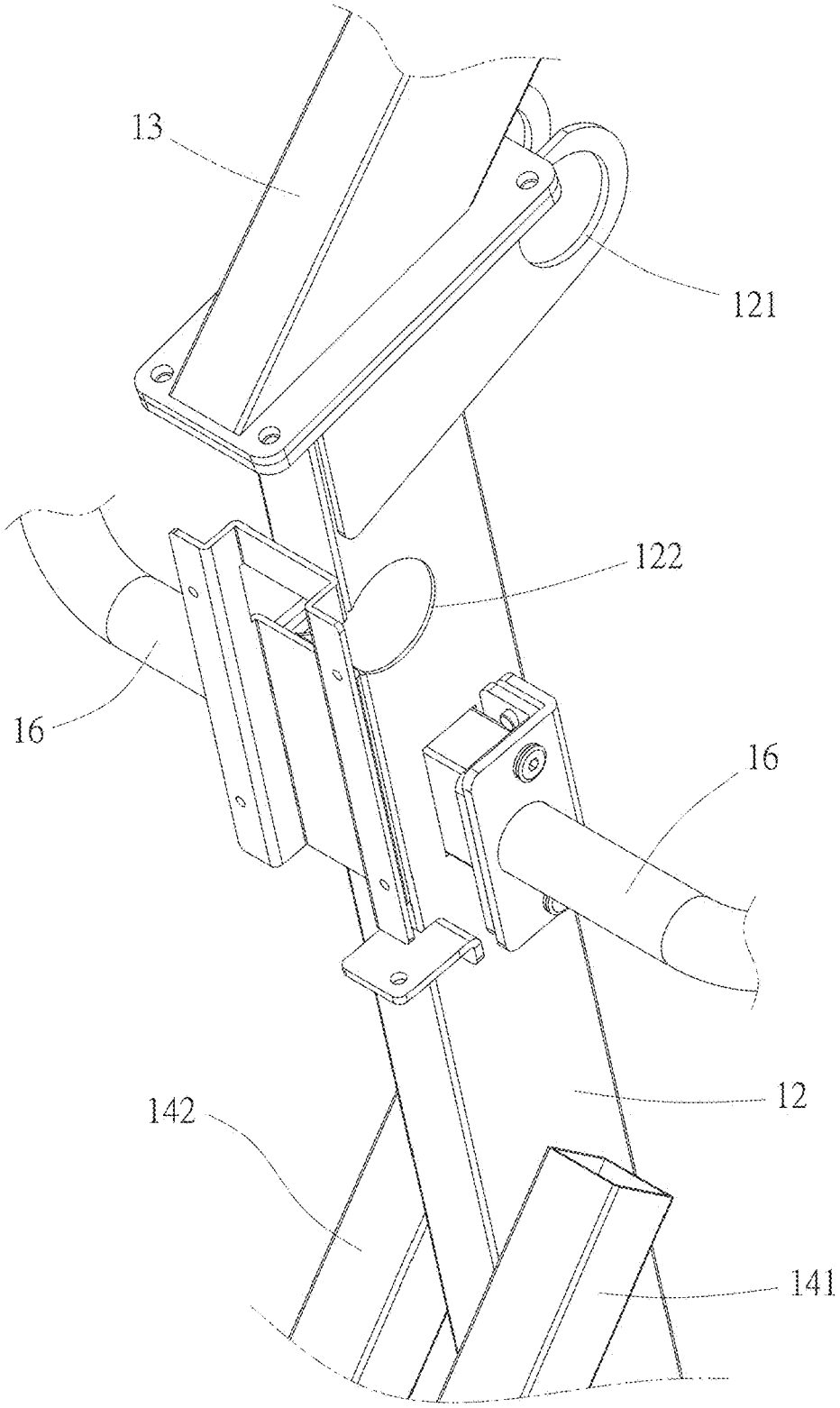
FIG. 4 is a schematic view showing the positions of the first pivot part and the second pivot part of the frame of the present invention.
Figure 5:
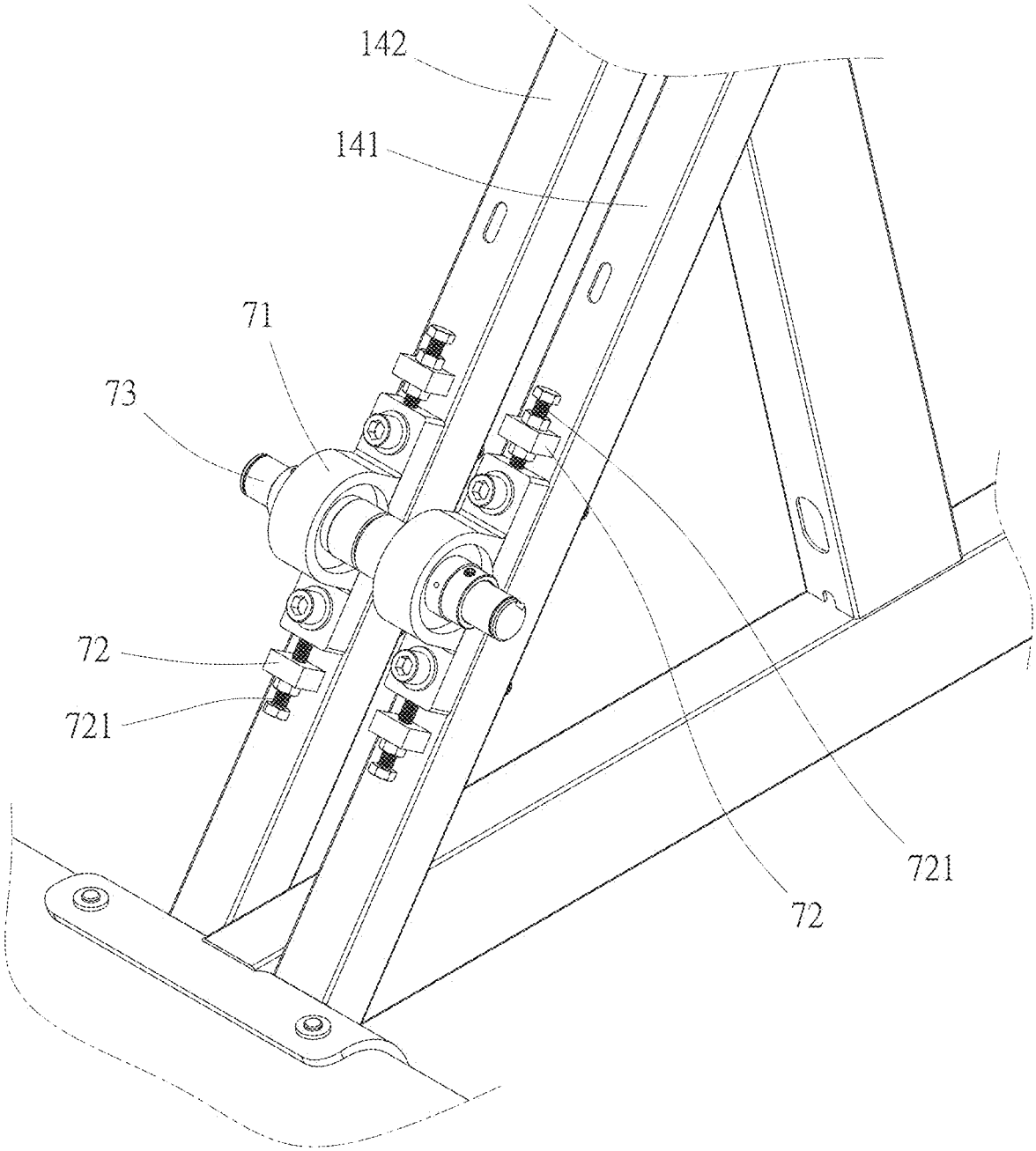
FIG. 5 is a schematic view showing the position of the third pivot part of the frame of the present invention.

As shown in FIG. 1 through FIG. 5, the present invention discloses an elliptical trainer, comprising a frame 1, two pedal units 2, two linkage units 3, a resistance unit 4, a first pivot part 5, a second pivot part 6, and a third pivot part 7.

The frame 1 includes a base 11, a post 12, an upper arm 13, a front connecting bracket 14, two immovable handlebars 15, two side armrests 16, and a display screen 17.

The base 11 extends in a horizontal direction. The post 12 is fixed to the base 11 and extends in a height direction. The upper arm 13 extends in the height direction and is fixed to an upper end of the post 12. The display screen 17 is fixed to an upper end of the upper arm 13. Specifically, the base 11 includes a base body 111 and two transverse supports 112. The two transverse supports 112 are connected to two opposite ends of the base body 111 and are perpendicular to the base body 111. Two support feet 113 and two guide wheels 114 are connected to the bottom of one of the transverse supports 112. Two support feet 113 are connected to the bottom of the other of the transverse supports 112.

The front connecting bracket 14 is connected between the base 11 and the post 12. Specifically, the front connecting bracket 14 includes a left connecting bracket 141 and a right connecting bracket 142. The left connecting bracket 141 and the right connecting bracket 142 are spaced a determined distance apart from each other.

The two immovable handlebars 15 are fixed to two sides of the upper arm 13. Front ends of the two side armrests 16 are connected to two opposite sides of the post 12. Rear ends of the two side armrests 16 are connected to the other of the transverse supports 112. The two pedal units 2 are located between the two side armrests 16. The display screen 17 is fixed to the upper end of the upper arm 13.

Figure 6:
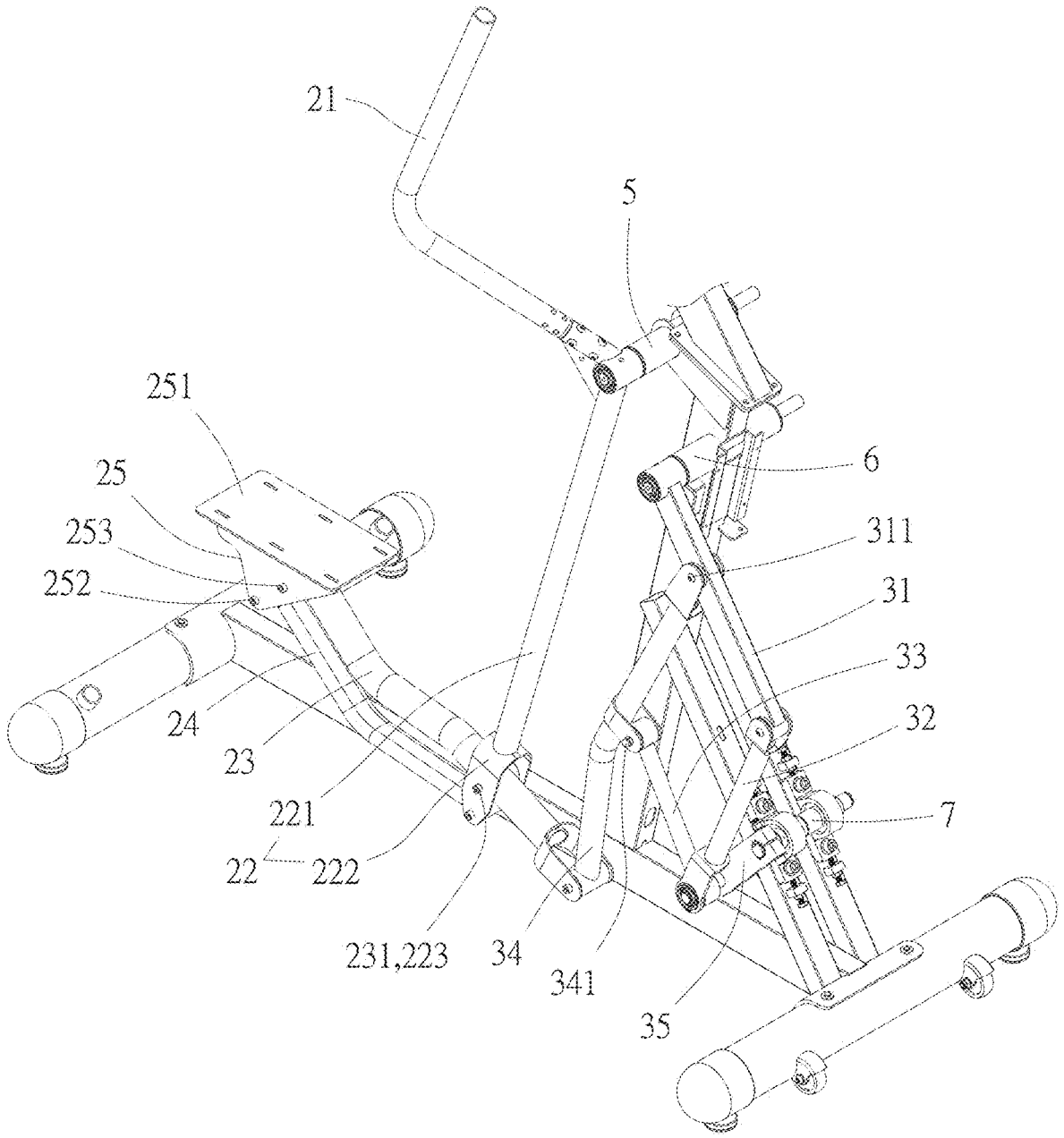
FIG. 6 is a schematic view showing the linkage unit and the pedal unit on the right side of the frame of the present invention.
Figure 7:
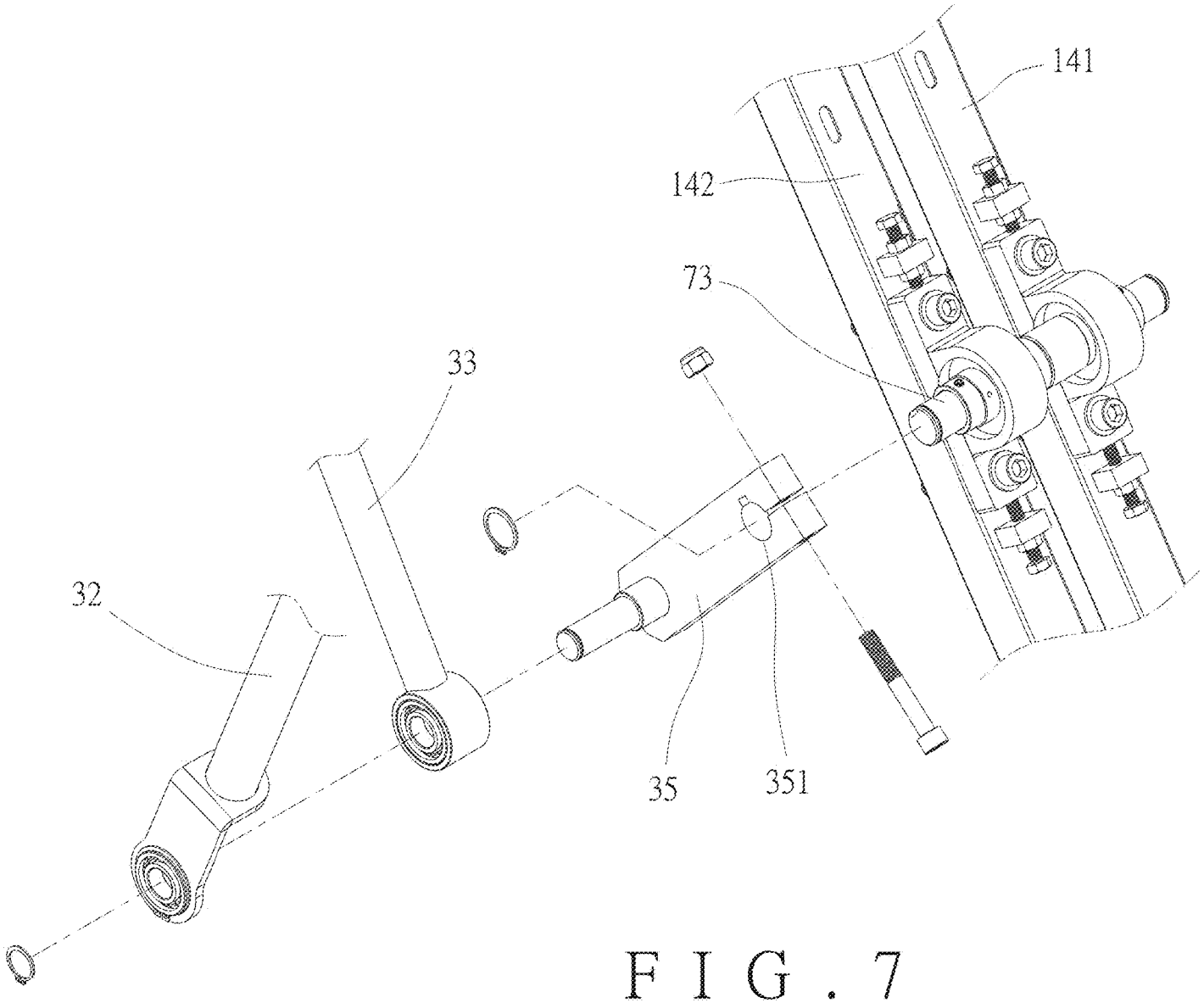
FIG. 7 is a partial exploded view showing the right linkage unit pivotally connected to the third pivot part of the present invention.
Figure 8:
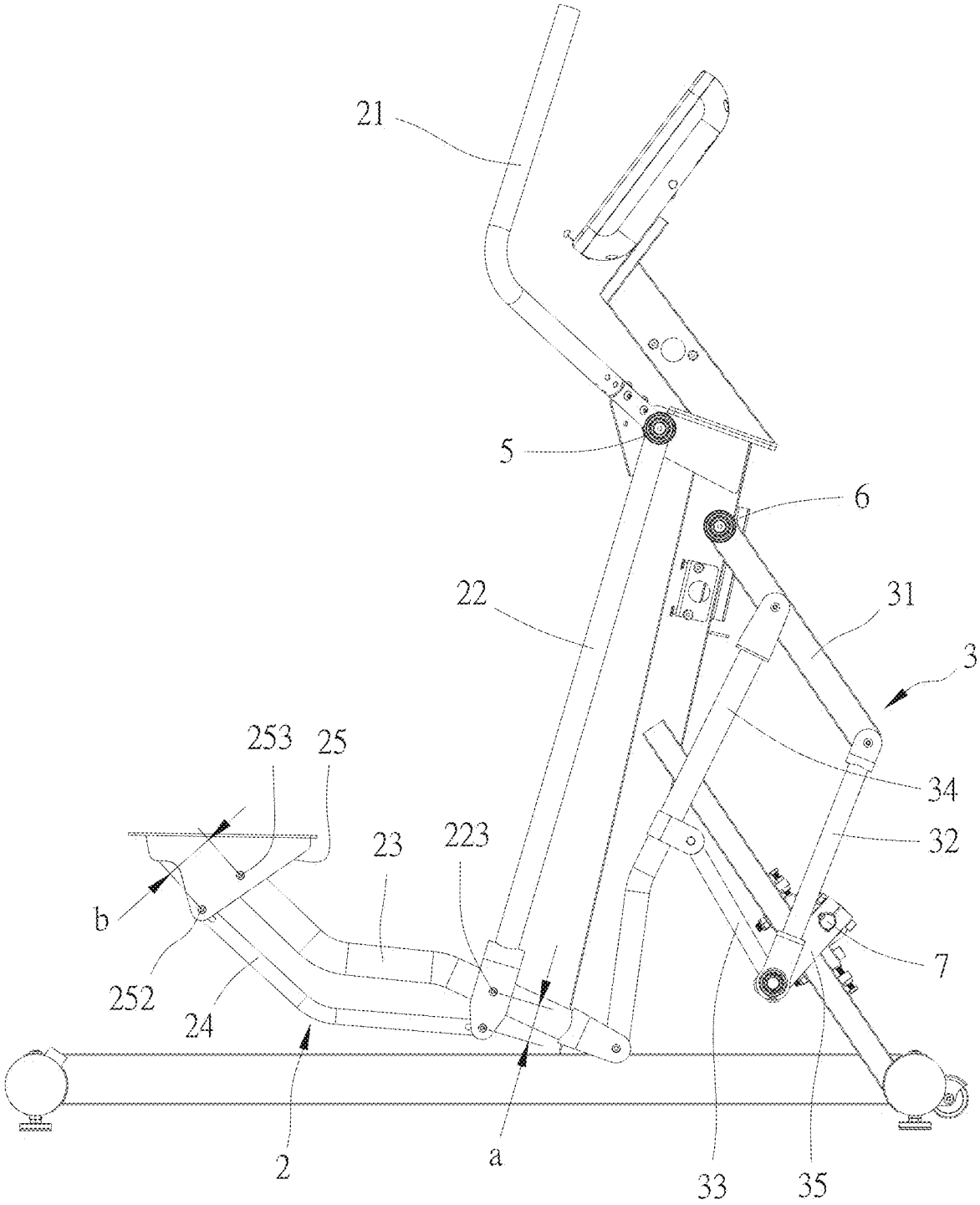
FIG. 8 is a side view of FIG. 6.
Figure 9:
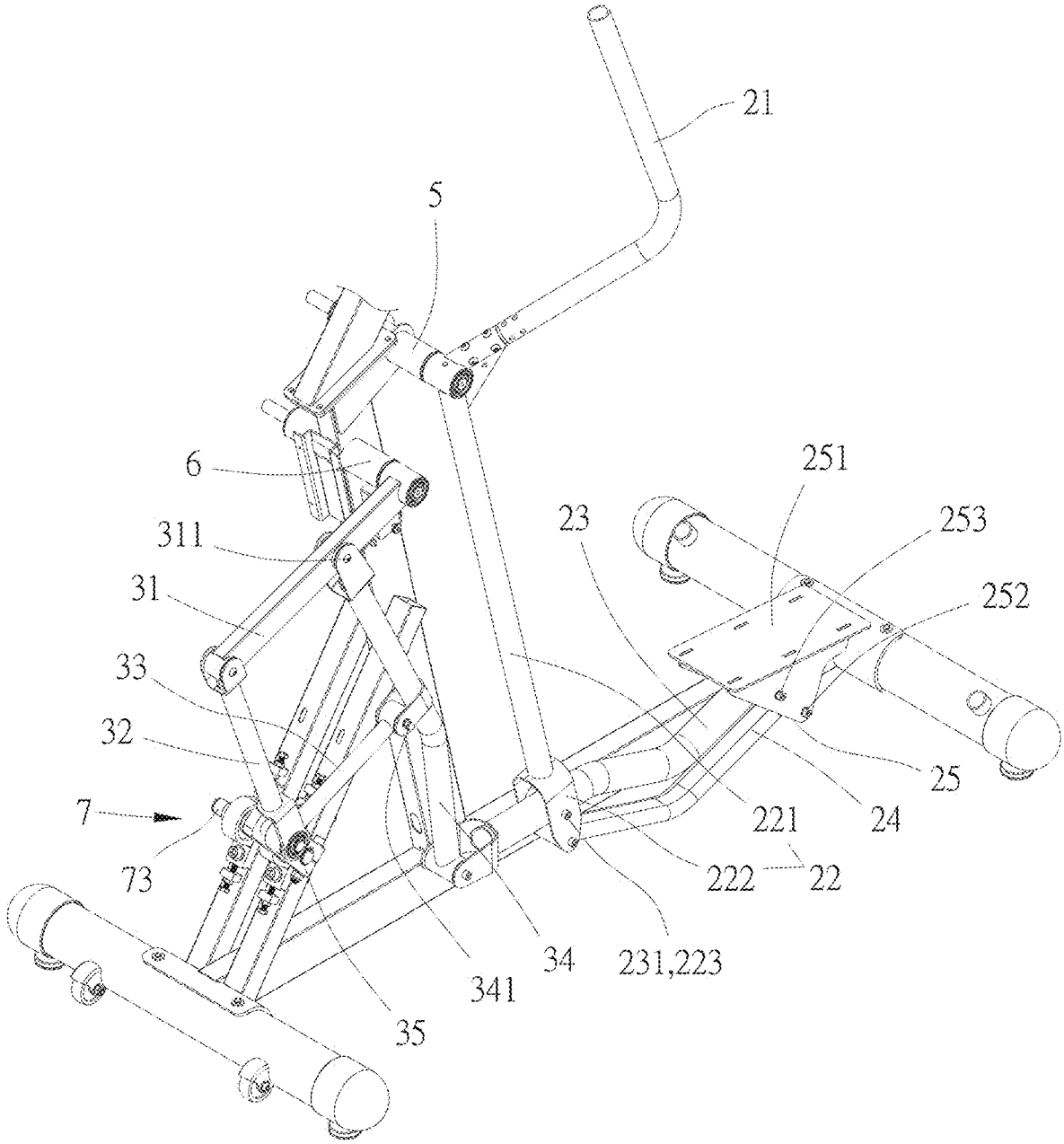
FIG. 9 is a schematic view showing the linkage unit and the pedal unit on the left side of the frame of the present invention.
Figure 10:
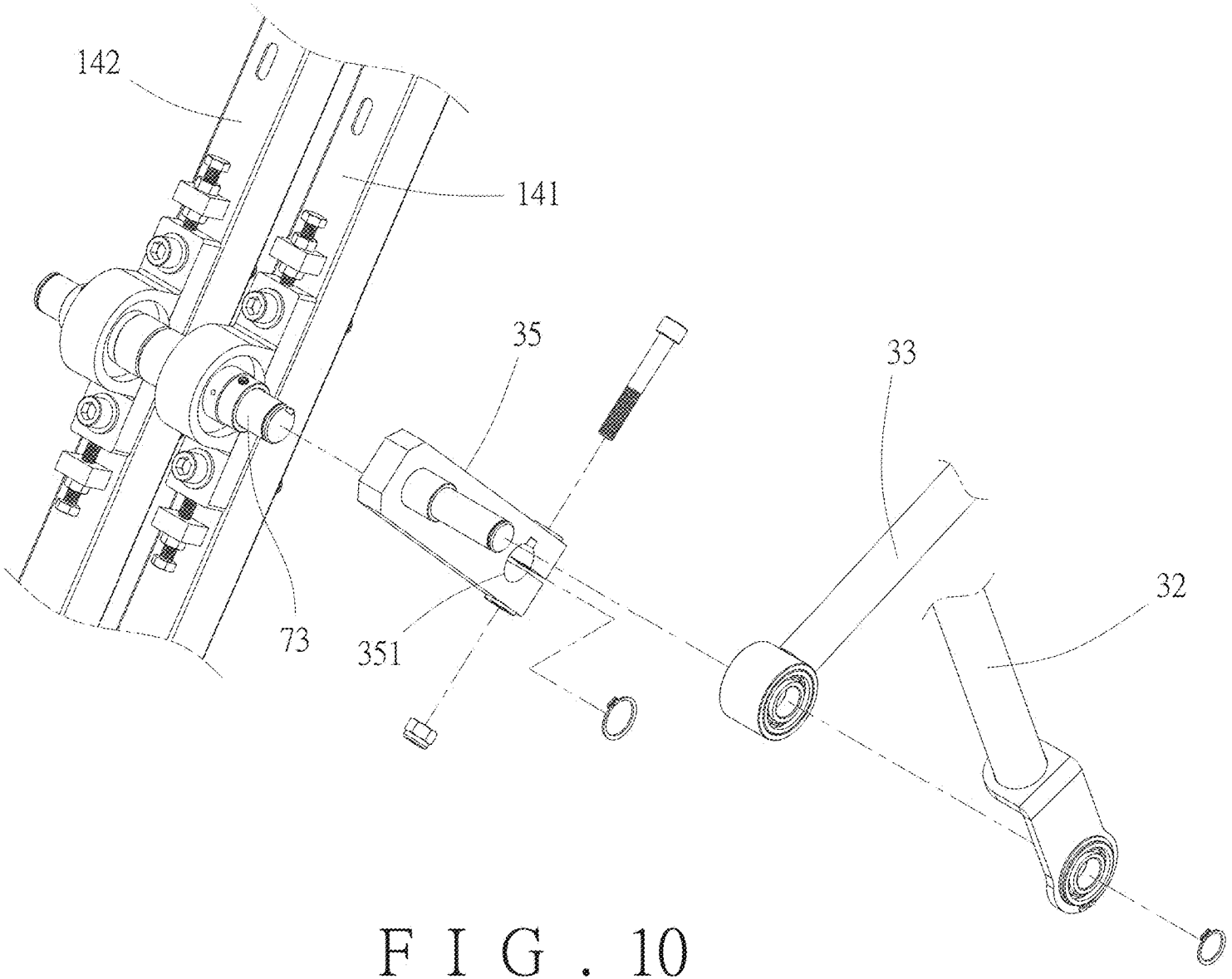
FIG. 10 is a partial exploded view showing the left linkage unit pivotally connected to the third pivot part of the present invention.
Figure 11:
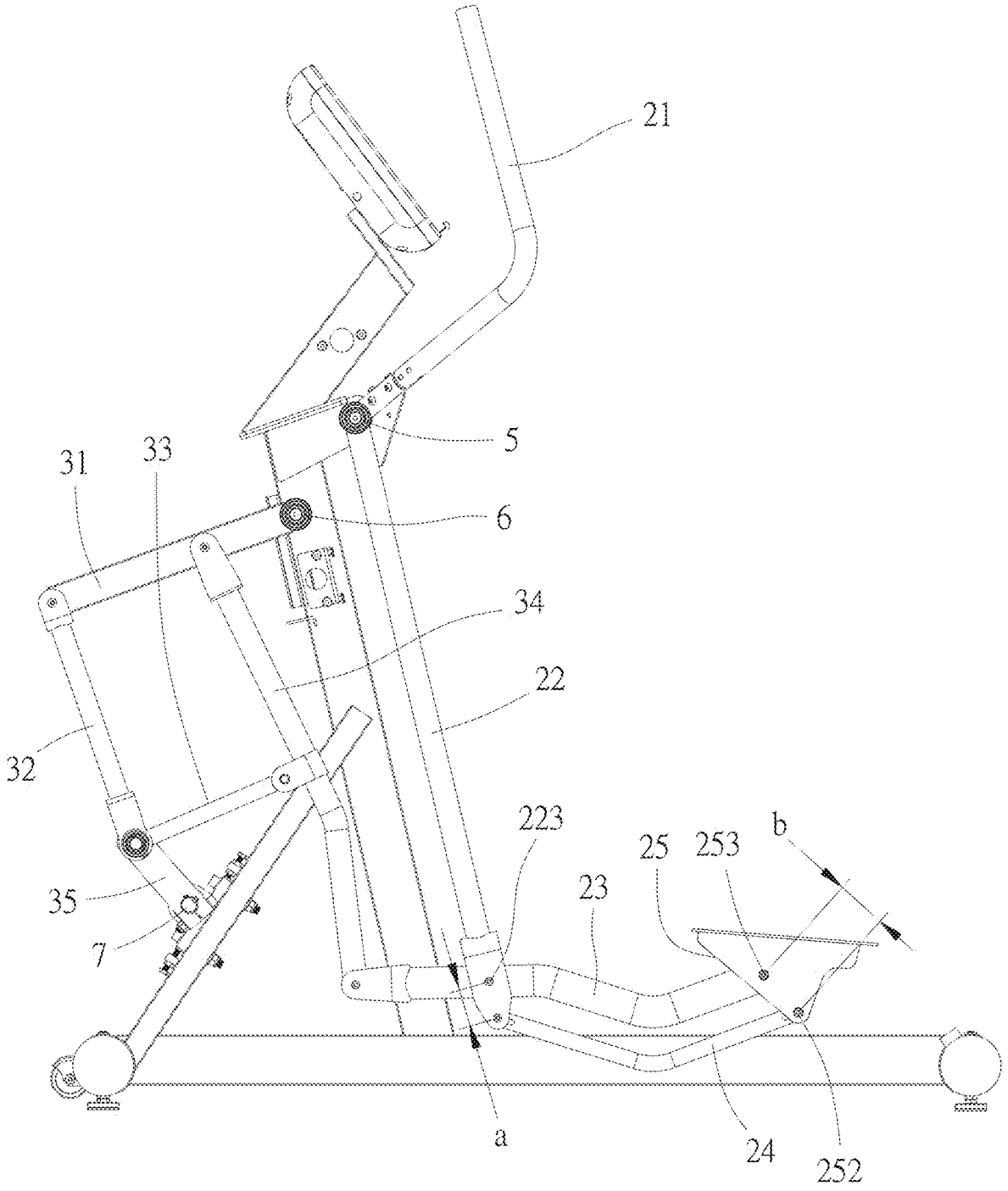
FIG. 11 is a side view of FIG. 9.

The first pivot part 5, the second pivot part 6 and the third pivot part 7 are sequentially arranged on the frame 1 from high to low in the height direction. The second pivot part 6 is between the first pivot part 5 and the third pivot part 7 in the horizontal direction. The first pivot part 5 and the second pivot part 6 are disposed on the post 12. The third pivot part 7 is disposed on the front connecting bracket 14. Specifically, the post 12 has a first receiving groove 121 and a second receiving groove 122. The first pivot part 5 is embedded in the first receiving groove 121. The second pivot part 6 is embedded in the second receiving groove 122. The third pivot part 7 includes two shaft seats 71, two adjustment screw assemblies 72, and a rotating shaft 73. The two shaft seats 71 are fixed to the left connecting bracket 141 and the right connecting bracket 142, respectively. The rotating shaft 73 is rotatably connected to the two shaft seats 71. The two adjustment screw assemblies 72 are arranged adjacent to the two shaft seats 71, respectively. Each adjustment screw assembly 72 has two adjustment screws 721. The two adjustment screws 721 are rotatable in the extension direction of the front connecting bracket 14 and are against two opposite ends of the shaft seat 71, respectively Referring to FIG. 6 through FIG. 11, the two pedal units 2 are disposed on two opposite sides of the frame 1, respectively. Each pedal unit 2 includes a movable handlebar 21, a handlebar rod 22, a pedal rod 23, a pedal bottom rod 24, and a foot pedal 25. The foot pedal 25 has a pedal face 251.

Upper and lower ends of the handlebar rod 22 are pivotally connected to the first pivot part 5 and one end of the pedal bottom rod 24, respectively. The other end of the pedal bottom rod 24 is pivotally connected to a lower pivot point 252 of the foot pedal 25. One end of the pedal rod 23 is pivotally connected to an upper pivot point 253 of the foot pedal 25. The upper pivot point 253 and the lower pivot point 252 are arranged adjacent to each other in the height direction. The pedal rod 23 has a pedal rod connection point 231 between two opposite ends thereof. The handlebar rod 22 has a handlebar rod connection point 223 between the upper and lower ends thereof. The pedal rod connection point 231 is connected to the handlebar rod connection point 223, so that the pedal rod 23 is pivotally connected to the handlebar rod 22. The movable handlebar 21 is connected to the upper end of the handlebar rod 22. The two movable handlebars 21 extend in the height direction and have a gradually enlarged section and a gripping section. Specifically, the handlebar rod 22 includes a rod-shaped section 221 and a U-shaped section 222 connected to the rod-shaped section 221. The rod-shaped section 221 is connected to the first pivot part 5. The U-shaped section 222 is connected to one end of the pedal bottom rod 24. The U-shaped section 222 has the handlebar rod connection point 223. The pedal rod 23 is inserted through the U-shaped section 222, and the pedal rod connection point 231 is pivotally connected to the handlebar rod connection point 223. A first distance a from the handlebar rod connection point 223 to the lower end of the handlebar rod 22 connected to the pedal bottom rod 24 is less than a second distance b between the upper pivot point 253 and the lower pivot point 252.

The two linkage units 3 are disposed on the two opposite sides of the frame 1 and connected to the two pedal units 2, respectively. Each linkage unit 3 includes a first bar 31, a second bar 32, a third bar 33, a fourth bar 34, and a rotating shaft connecting member 35.

One end of the first bar 31 is pivotally connected to the second pivot part 6. The other end of the first bar 31 is pivotally connected to one end of the second bar 32. The other end of the second bar 32 and one end of the third bar 33 are pivotally connected to one end of the rotating shaft connecting member 35. The other end of the rotating shaft connecting member 35 is pivotally connected to the third pivot part 7. The rotating shaft connecting members 35 of the two linkage units 3 on the two sides of the frame 1 are arranged 180 degrees apart in the radial direction of the third pivot part 7. The first bar 31 has a first bar connection point 311 between the two opposite ends of the first bar 31. The fourth bar 34 has a fourth bar connection point 341 between two opposite ends of the fourth bar 34. One end of the fourth bar 34 is pivotally connected to the first bar connection point 311. The other end of the third bar 33 is pivotally connected to the fourth bar connection point 341. The other end of the fourth bar 34 is pivotally connected to the other end of the pedal rod 23. Specifically, the first bar 31, the second bar 32, the third bar 33 and the fourth bar 34 are connected to form a four-bar linkage. One end of the second bar 32 is U-shaped. The two opposite ends of the fourth bar 34 and the fourth bar connection point 341 are U-shaped. The other end of the rotating shaft connecting member 35 has a clamping groove 351. The end of the rotating shaft 73 is secured by the clamping groove 351 so that the rotating shaft connecting member 35 is rotated synchronously along with the rotating shaft 73.

Figure 12:
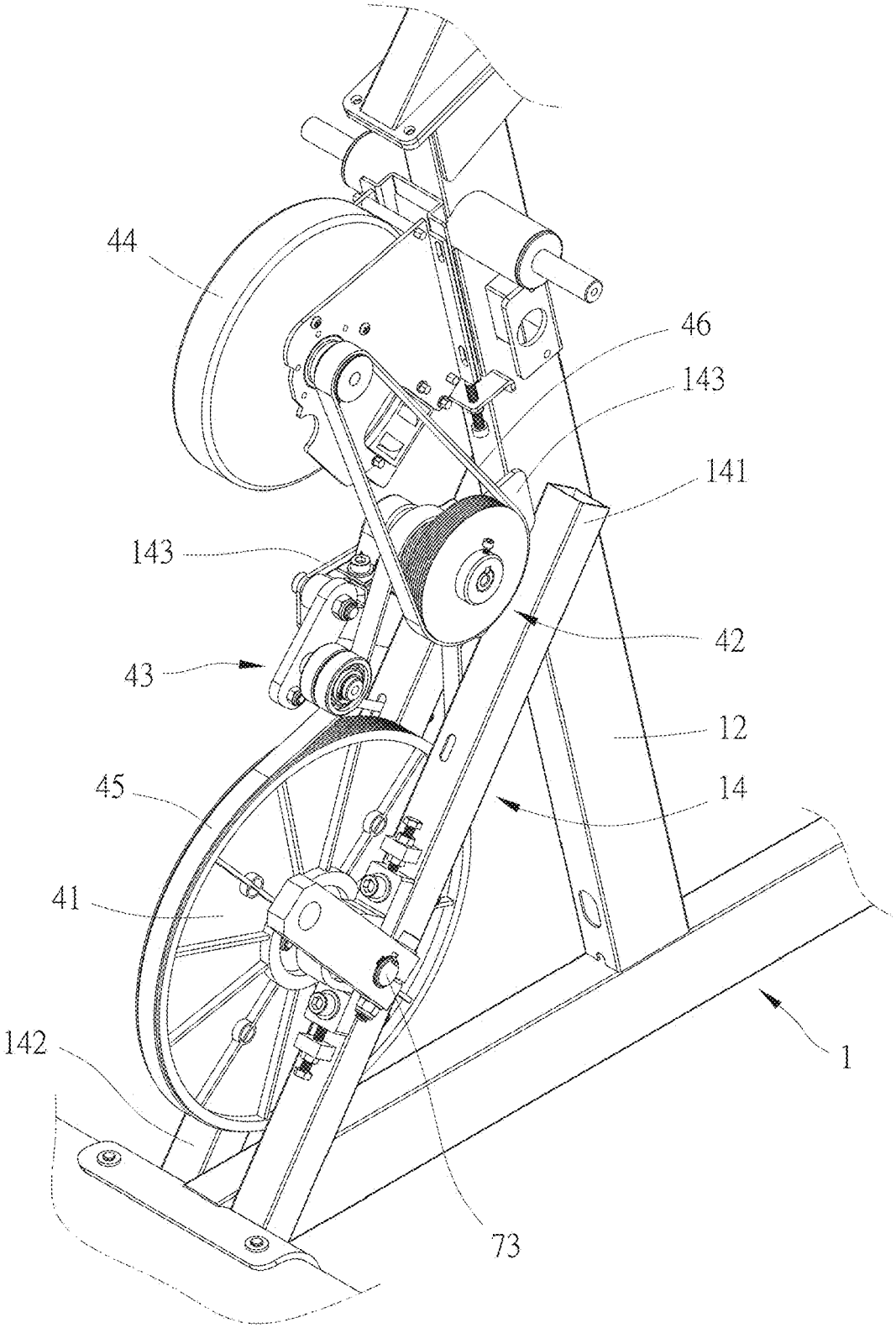
FIG. 12 is a perspective view of the resistance unit disposed on the frame of the present invention.
Figure 13:
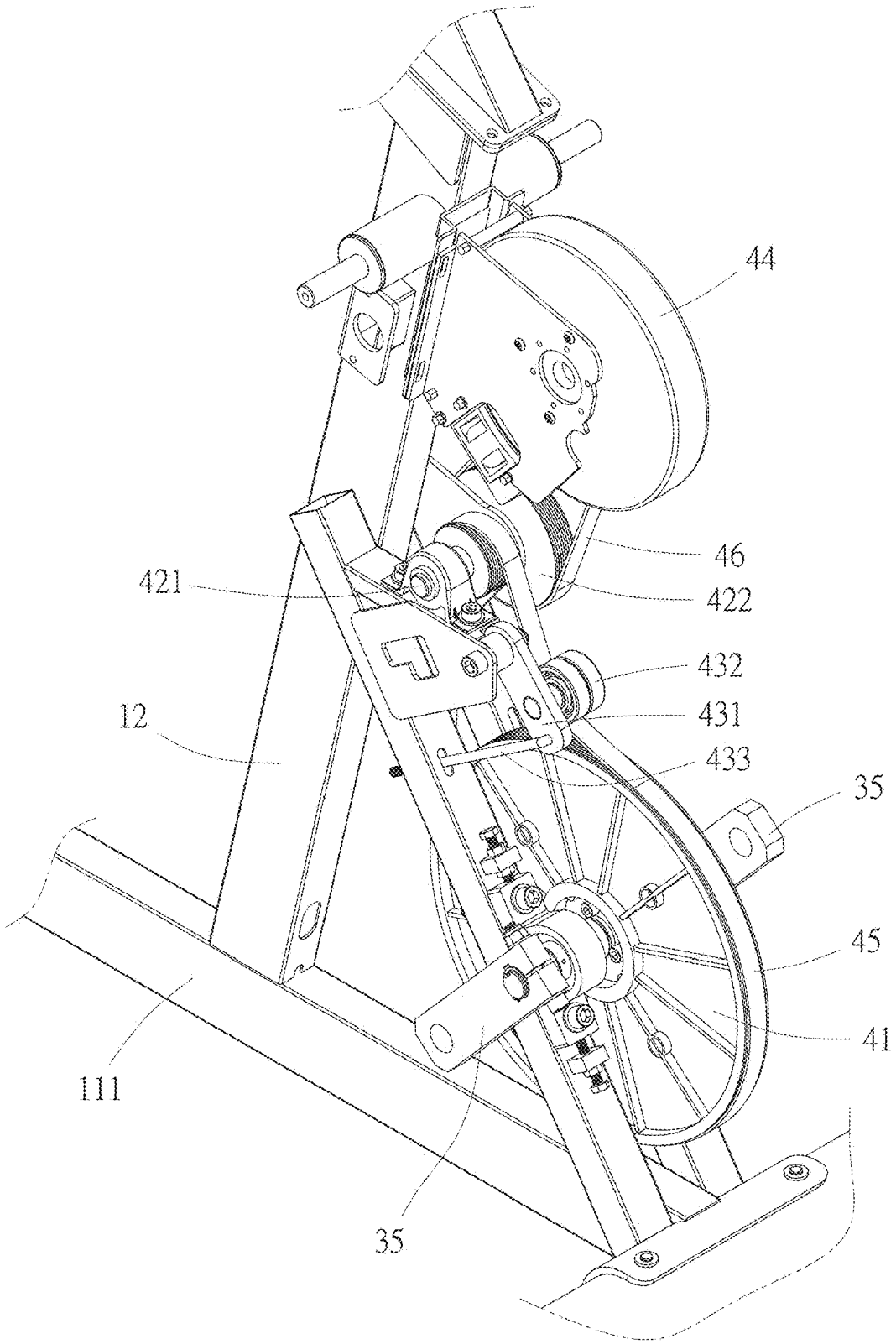
FIG. 13 is another perspective view of the resistance unit of the present invention.
Figure 14:
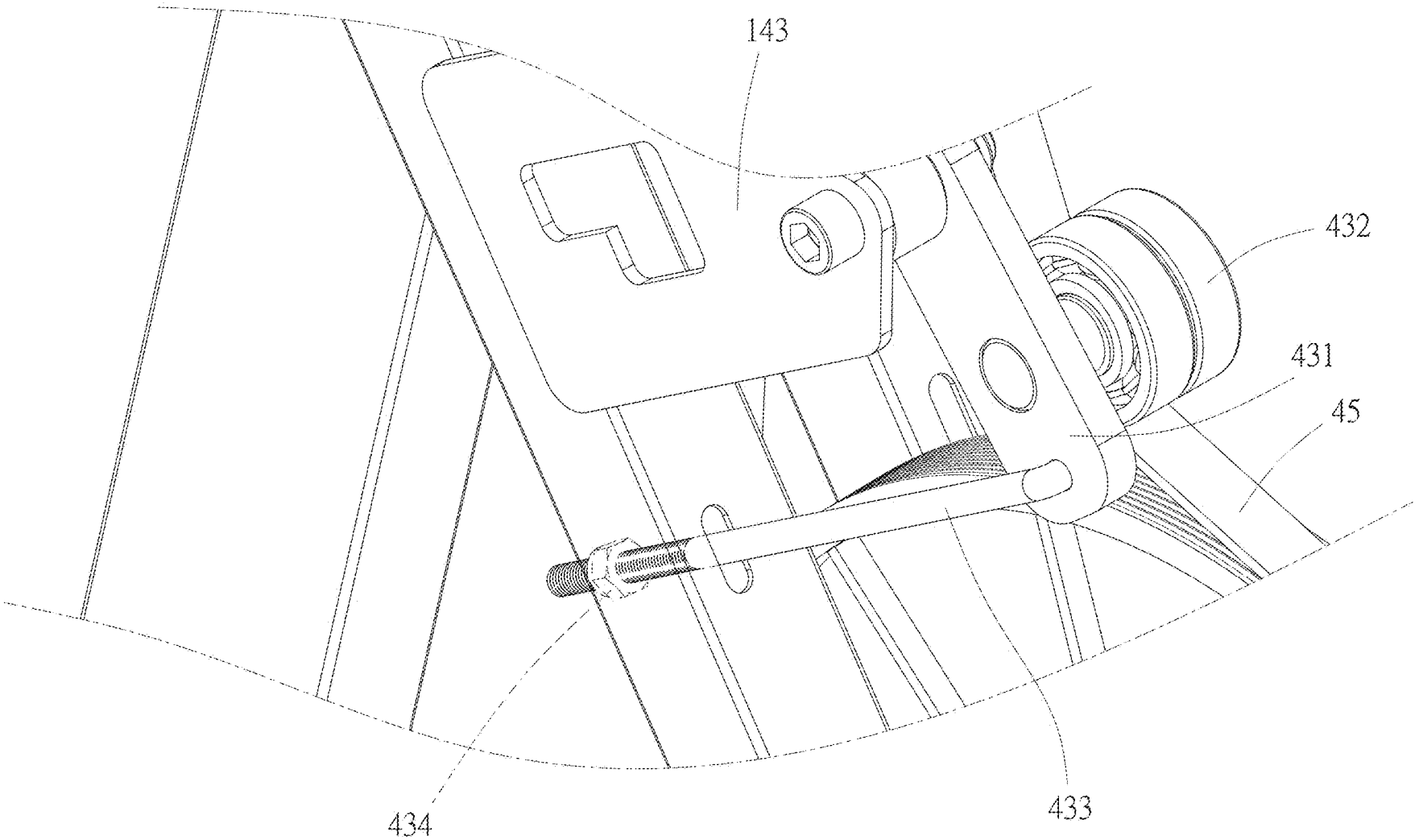
FIG. 14 is a partial perspective view of the resistance unit of the present invention.

Referring to FIG. 1, FIG. 12, FIG. 13 and FIG. 14, the resistance unit 4 is disposed on the frame 1 and connected to the third pivot part 7. The two pedal units 2 are connected to the resistance unit 4 via the corresponding linkage units 3. Specifically, the resistance unit 4 includes an output wheel 41, a transmission wheel 42, a tension wheel unit 43, and a resistance wheel 44. The output wheel 41 is disposed on the rotating shaft 73 and rotates synchronously along with the rotating shaft 73. The output wheel 41 is located within the determined distance and between the left connecting bracket 141 and the right connecting bracket 142.

The transmission wheel 42 and the resistance wheel 44 are rotatably connected to the frame 1. The output wheel 41 drives and is connected to the transmission wheel 42 via a first belt 45. Specifically, the transmission wheel 42 is located at a position of the front connecting bracket 14 close to the post 12. Two support plates 143 are provided on the front connecting bracket 14. The two support plates 143 each have a bearing and a bearing seat. The transmission wheel 42 has a transmission shaft 421 and a transmission wheel body 422. The transmission shaft 421 passes through the bearing and the bearing seat. The transmission wheel body 422 is connected to the transmission shaft 421 and rotates synchronously along with the transmission shaft 421. The first belt 45 is wound around the output wheel 41 and the transmission shaft 421. A second belt 46 is wound around the transmission wheel body 422 and the resistance wheel 44. The tension wheel unit 43 includes a swing arm 431, a tension wheel body 432, a pull rod 433, and an adjustment nut 434. The tension wheel body 432 is swingable and connected to one of the support plates 143 via the swing arm 431. The tension wheel body 432 is against the first belt 45. The adjustment nut 434 is adjustable and disposed on the pull rod 433. One end of the pull rod 433 is connected to the swing arm 431. The other end of the pull rod 433 passes through the right connecting bracket 142 and the position of the pull rod 433 is confined by the adjustment nut 434, thereby changing the force exerted by the tension wheel body 432 on the first belt 45.

Figure 15:
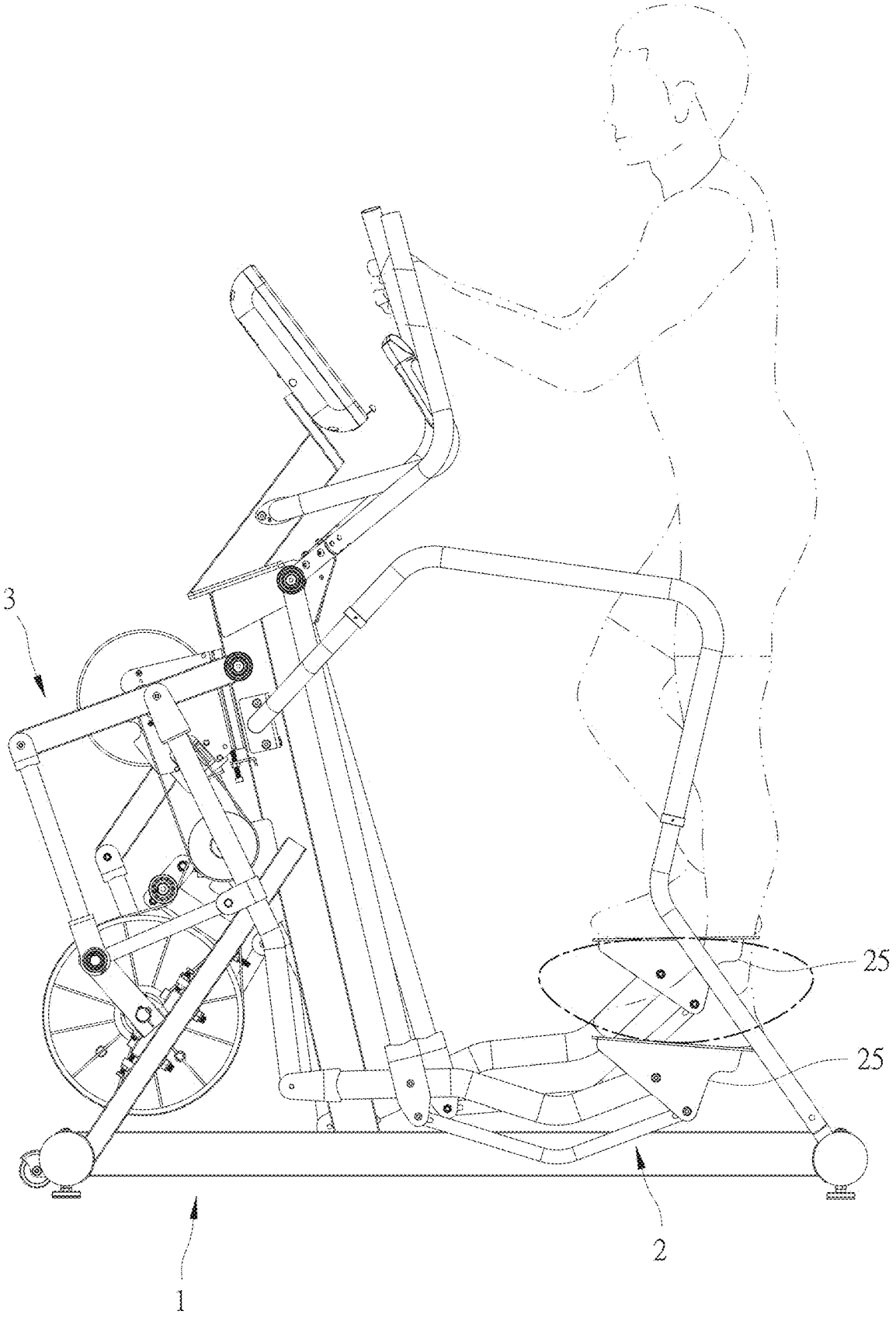
FIG. 15 is a schematic view of the present invention when in use, wherein the foot pedals are moved along the closed path and the right foot pedal is higher than the left foot pedal.
Figure 16:
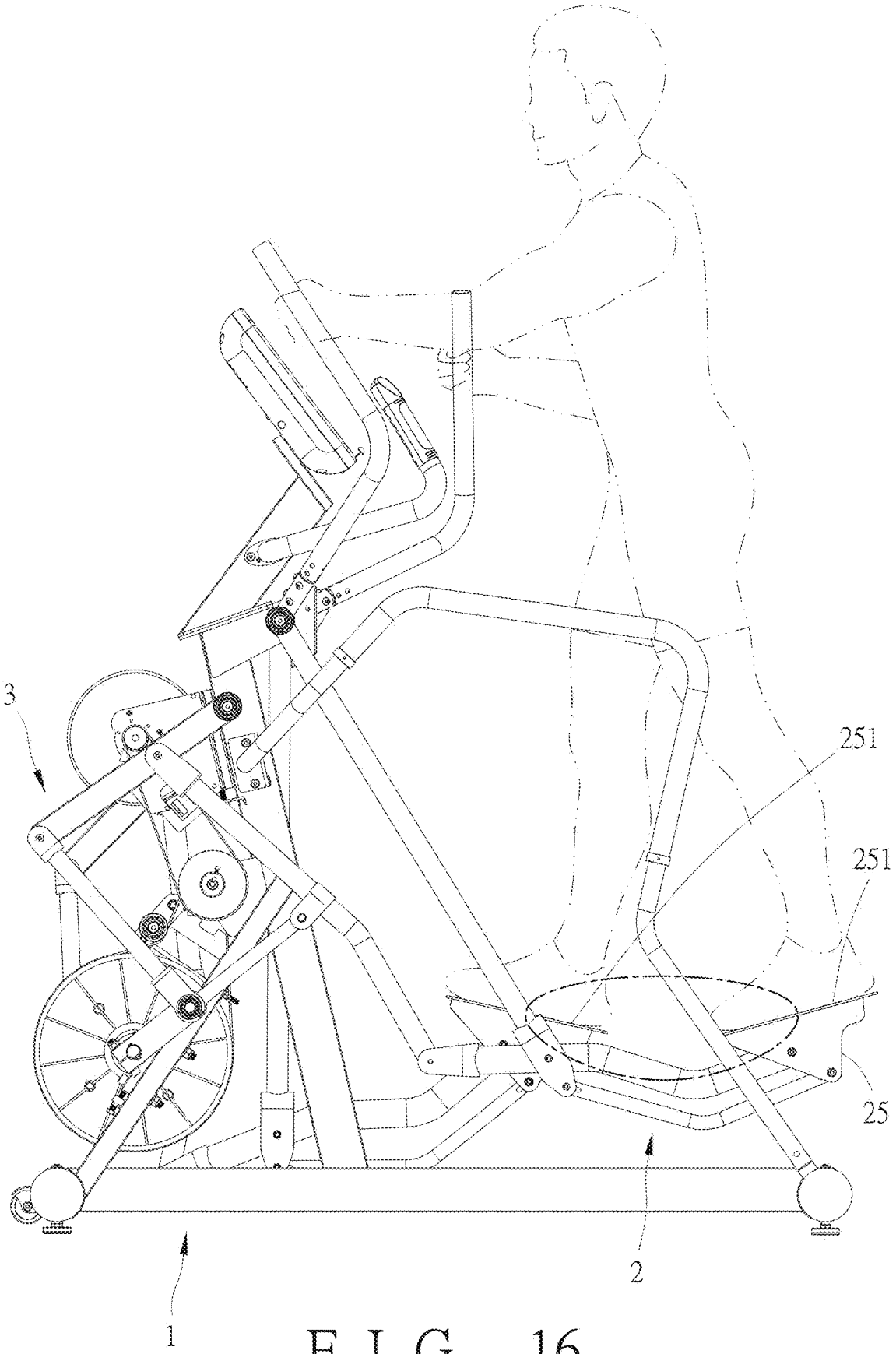
FIG. 16 is a schematic view of the present invention when in use, wherein the foot pedals are moved along the closed path and the right foot pedal is in front of the left foot pedal.
Figure 17:
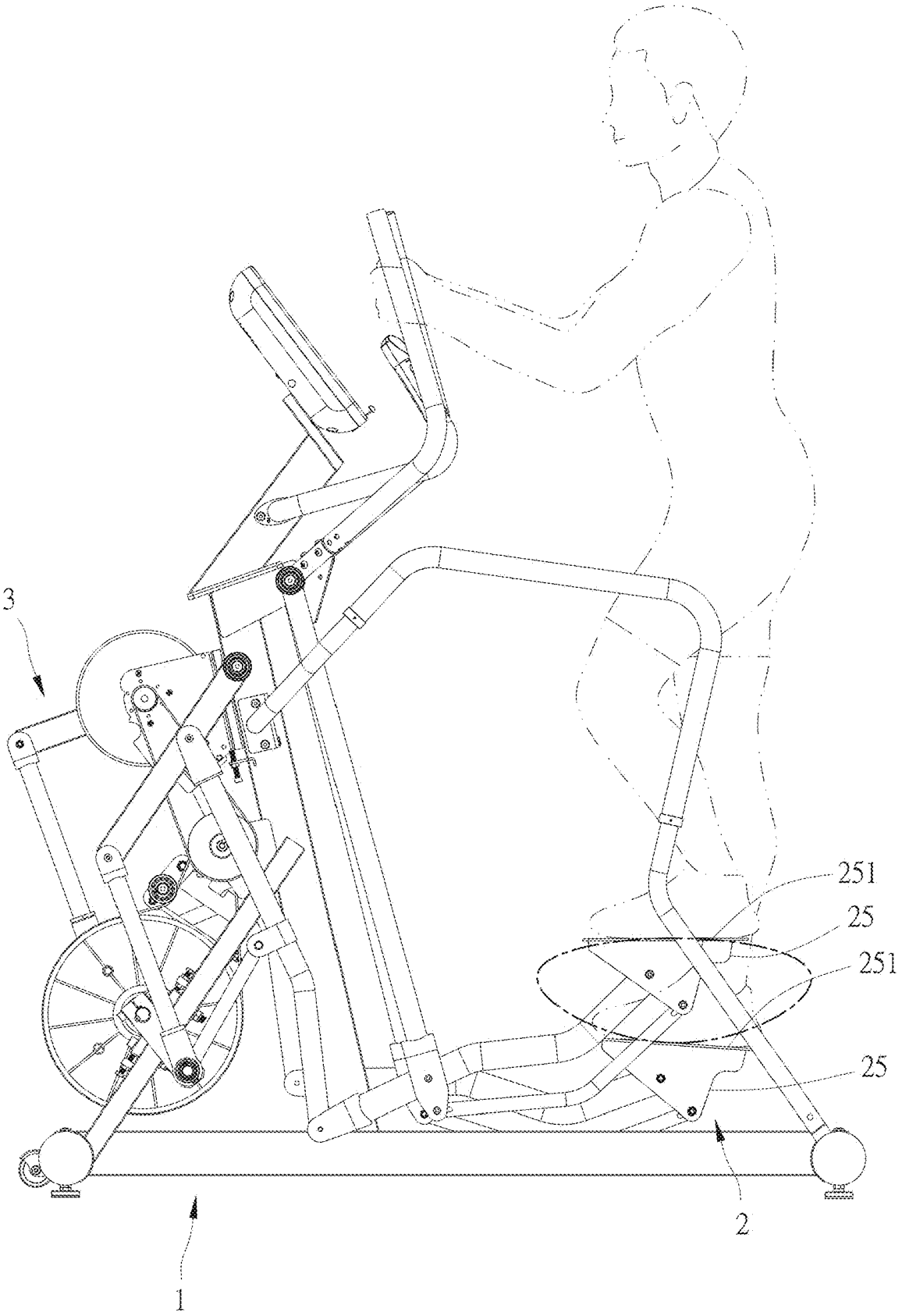
FIG. 17 is a schematic view of the present invention when in use, wherein the foot pedals are moved along the closed path and the right foot pedal is lower than the left foot pedal.
Figure 18:
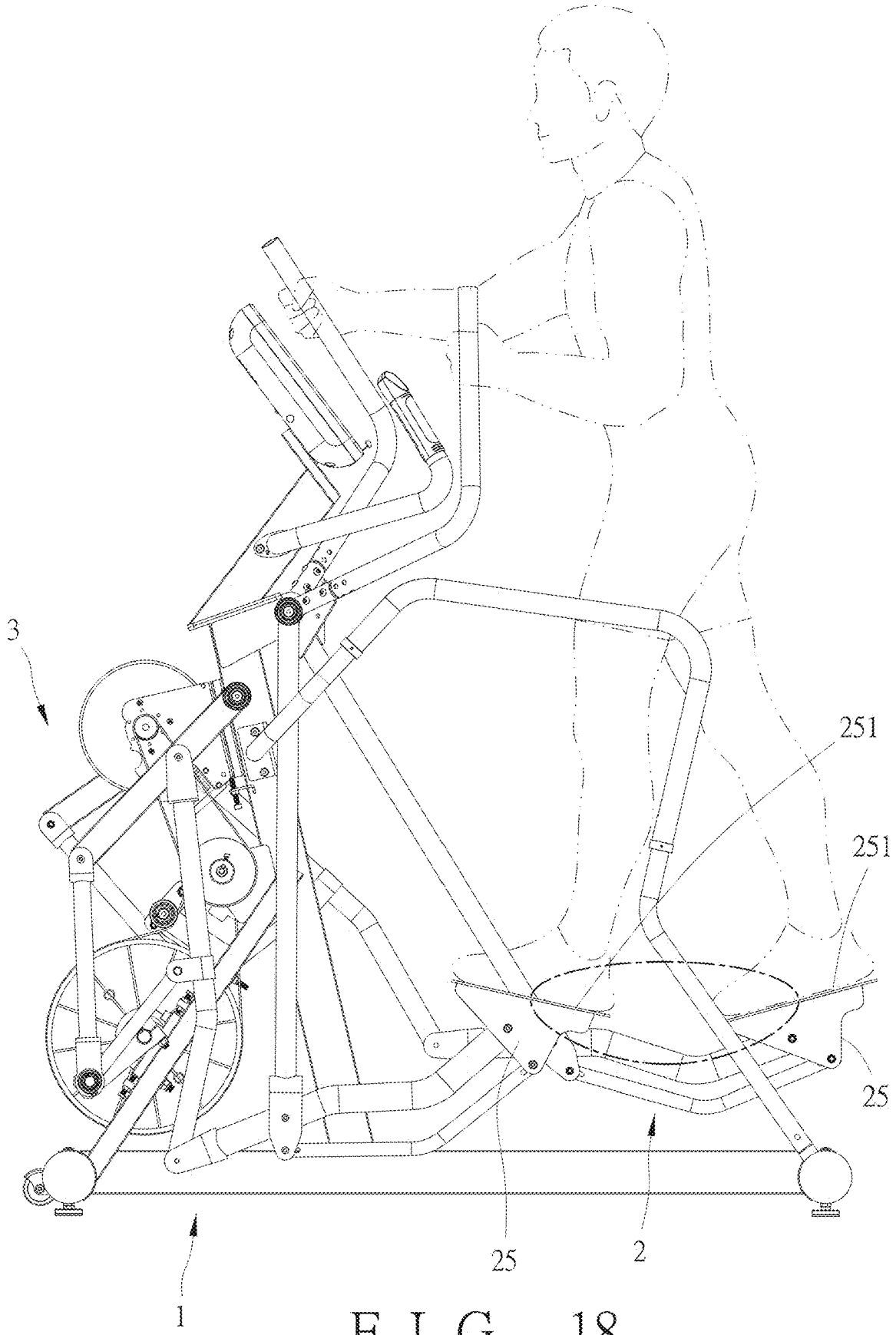
FIG. 18 is a schematic view of the present invention when in use, wherein the foot pedals are moved along the closed path and the right foot pedal is behind the left foot pedal.

Referring to FIG. 15, FIG. 16, FIG. 17 and FIG. 18, when in use, the user treads the foot pedals 25 located on the two sides of the frame 1 with both feet. By treading the foot pedals 25, the pedal units 2 and the linkage units 3 are driven, so that the foot pedals 25 located on the two sides of the frame 1 are moved along a closed path. The two foot pedals 25 are located on two opposite sides of the center of the closed path when moved. When the two foot pedals 25 are moved and located on the two opposite sides of the center of the closed path in the horizontal direction, the pedal faces 251 of the two foot pedals 25 are inclined at an angle toward the center of the closed path. This simulates the back and forth motions of the feet, that is, the toes of the foot that moves to the front edge is raised and hell of the foot that moves to the rear edge is raised, so that the motions are closer to the actual walking or running.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An elliptical trainer, comprising:

a frame, including a base, a post and a front connecting bracket, the base extending in a horizontal direction, the post being fixed to the base and extending in a height direction, the front connecting bracket being connected between the base and the post, the frame having a first pivot part, a second pivot part and a third pivot part that are arranged on the frame sequentially from high to low in the height direction, the second pivot part being located between the first pivot part and the third pivot part in the horizontal direction, the first pivot part and the second pivot part being disposed on the post, the third pivot part being disposed on the front connecting bracket;

two pedal units, disposed on two opposite sides of the frame, the pedal units each including a handlebar rod, a pedal rod, and a foot pedal, the foot pedal having a pedal face, one end of the handlebar rod being pivotally connected to the first pivot part, one end of the pedal rod being pivotally connected to an upper pivot point of the foot pedal, the pedal rod having a pedal rod connection point between two opposite ends thereof, the handlebar rod having a handlebar rod connection point between the upper and lower ends thereof, the pedal rod connection point being connected to the handlebar rod connection point so that the pedal rod is pivotally connected to the handlebar rod;

two linkage units, disposed on the two opposite sides of the frame and connected to the two pedal units respectively, the linkage units each including a first bar, a second bar, a third bar, a fourth bar and a rotating shaft connecting member, one end of the first bar being pivotally connected to the second pivot part, another end of the first bar being pivotally connected to one end of the second bar, another end of the second bar and one end of the third bar being pivotally connected to one end of the rotating shaft connecting member, another end of the rotating shaft connecting member being pivotally connected to the third pivot part, the rotating shaft connecting members of the two linkage units on the two sides of the frame being arranged 180 degrees apart in a radial direction of the third pivot part; the first bar having a first bar connection point between the two opposite ends of the first bar, the fourth bar having a fourth bar connection point between two opposite ends of the fourth bar, one end the fourth bar being pivotally connected to the first bar connection point, another end of the third bar being pivotally connected to the fourth bar connection point, the other end the fourth bar being pivotally connected to the other end of the pedal rod;

a resistance unit, disposed on the frame and connected to the third pivot part, the two pedal units being connected to the resistance unit via the corresponding linkage units;

wherein when in use, the foot pedals of the two pedal units on the two sides of the frame are driven to move along a closed path, and the two foot pedals are located on two opposite sides of a center of the closed path when moved.

2. The elliptical trainer as claimed in claim 1, wherein the first bar, the second bar, the third bar and the fourth bar are connected to form a four-bar linkage.

3. The elliptical trainer as claimed in claim 1, wherein each pedal unit includes a pedal bottom rod, another end of the handlebar rod is pivotally connected to one end of the pedal bottom rod, another end of the pedal bottom rod is pivotally connected to a lower pivot point of the foot pedal, the upper pivot point and the lower pivot point are arranged adjacent to each other in the height direction, and a first distance from the handlebar rod connection point to the end of the handlebar rod connected to the pedal bottom rod is less than a second distance between the upper pivot point and the lower pivot point; wherein when the two foot pedals are moved and located on the two opposite sides of the center of the closed path in the horizontal direction, the pedal faces of the two foot pedals are inclined at an angle toward the center of the closed path.

4. The elliptical trainer as claimed in claim 1, wherein the pedal units each include a movable handlebar, the movable handlebar is connected to the upper end of the handlebar rod, and the two movable handlebars of the pedal units extend in the height direction and have a gradually enlarged section and a gripping section.

5. The elliptical trainer as claimed in claim 1, wherein the frame further includes an upper arm, two immovable handlebars and a display screen, the upper arm extends in the height direction and is fixed to the post, the two immovable handlebars are fixed to two sides of the upper arm, and the display screen is fixed to an upper end of the upper arm.

6. The elliptical trainer as claimed in claim 1, wherein the base includes a base body and two transverse supports, the two transverse supports are connected to two opposite ends of the base body, and the two transverse supports each have two support feet and two guide wheels.

7. The elliptical trainer as claimed in claim 6, wherein the frame includes two side armrests, front ends of the two side armrests are connected to two opposite sides of the post, rear ends of the two side armrests are connected to a rear one of the two transverse supports, and the two pedal units are located between the two side armrests.

8. The elliptical trainer as claimed in claim 1, wherein the front connecting bracket includes a left connecting bracket and a right connecting bracket, the left connecting bracket and the right connecting bracket are spaced a determined distance apart from each other, the third pivot part includes two shaft seats and a rotating shaft, the two shaft seats are respectively fixed to the left connecting bracket and the right connecting bracket, and the rotating shaft is rotatably connected to the two shaft seats.

9. The elliptical trainer as claimed in claim 8, wherein the third pivot part further includes two adjustment screw assemblies, the two adjustment screw assemblies are respectively arranged adjacent to the two shaft seats, the two adjustment screw assemblies each have two adjustment screws, and the two adjustment screws are rotatable and are against two opposite ends of a corresponding one of the shaft seats, respectively.

10. The elliptical trainer as claimed in claim 8, wherein the resistance unit includes an output wheel, a transmission wheel and a resistance wheel, the output wheel is disposed on the rotating shaft and rotates synchronously along with the rotating shaft, the transmission wheel and the resistance wheel are rotatably connected to the frame, the output wheel drives and is connected to the transmission wheel via a first belt, and the transmission wheel drives and is connected to the resistance wheel via a second belt.

* * * * *